US006068162A

United States Patent [19]

De Winter et al.

[11] Patent Number: 6,068,162

[45] Date of Patent: May 30, 2000

[54] ADJUSTABLE SOAP DISPENSER

[75] Inventors: Keon De Winter; Mattie Chinks, both of Montreal, Canada

[73] Assignee: Avmor Ltd., Montréal, Canada

[21] Appl. No.: 09/252,426

[22] Filed: Feb. 18, 1999

[51] Int. Cl.[7] ..... B67D 5/06

[52] U.S. Cl. ..... 222/181.3; 222/214; 222/308; 222/309; 222/325

[58] Field of Search ..... 222/181.3, 182, 222/207, 209, 214, 287, 307, 308, 309, 325

[56] References Cited

U.S. PATENT DOCUMENTS

| | | | |
|---|---|---|---|
| 4,036,406 | 7/1977 | Jespersen et al. | 222/181 |
| 4,164,306 | 8/1979 | Perrin | 222/181 |
| 4,238,056 | 12/1980 | Tucker et al. | 222/181 |
| 4,429,812 | 2/1984 | Steiner et al. | 222/181 |
| 4,493,440 | 1/1985 | Von Buelow et al. | 222/109 |
| 4,621,749 | 11/1986 | Kanfer | 222/181.3 |
| 4,741,461 | 5/1988 | Williamson et al. | 222/181 |
| 4,895,276 | 1/1990 | Maldonado | 222/214 |
| 4,928,857 | 5/1990 | Ecker | 222/211 |
| 4,932,562 | 6/1990 | Christine | 222/214 |
| 4,961,508 | 10/1990 | Weimer et al. | 222/287 |
| 5,165,577 | 11/1992 | Ophardt | 222/181 |
| 5,174,476 | 12/1992 | Steiner et al. | 222/181 |
| 5,186,360 | 2/1993 | Mease et al. | 222/63 |
| 5,265,772 | 11/1993 | Bartasevich et al. | 222/214 |
| 5,373,970 | 12/1994 | Ophardt | 222/181 |
| 5,421,489 | 6/1995 | Holzner, Sr. et al. | 222/207 |
| 5,431,309 | 7/1995 | Ophardt | 222/181.3 |
| 5,464,125 | 11/1995 | Daansen | 222/214 |
| 5,469,990 | 11/1995 | Woodeslavsky | 222/148 |
| 5,492,247 | 2/1996 | Shu et al. | 222/63 |
| 5,507,413 | 4/1996 | Chen | 222/63 |
| 5,556,005 | 9/1996 | Banks | 222/96 |
| 5,706,986 | 1/1998 | Brandenburg et al. | 222/192 |
| 5,810,204 | 9/1998 | Devlin et al. | 222/287 |

*Primary Examiner*—Joseph A. Kaufman
*Attorney, Agent, or Firm*—Robic

[57] ABSTRACT

This invention relates to an improved liquid soap dispenser of the type ones which are commonly located in public washrooms and the like. These kind of soap dispensers include a frame, a manually operable pump mounted on the frame and a reservoir operatively connected to the pump for supplying soap to be dispensed. The soap is generally dispensed when a tube, connected to the reservoir, is squeezed. The current invention provides simple and efficient ways for controlling the quantity of soap dispensed from such liquid soap dispenser. As such, the amount of pressure provided to the tube is varied, thereby varying the amount of soap dispensed. Preferably, the pump includes a handle and a wall portion facing each other on opposite sides of the tube. The wall member is pivotable about a pivot point, so that by increasing the angle between the wall member and the tube, the handle does not compress the tube as much and thus less soap is dispensed.

20 Claims, 9 Drawing Sheets

ADJUSTABLE SOAP DISPENSER

FIELD OF THE INVENTION

This invention relates to an improved soap dispenser of the type for dispensing liquid soap and the like.

DESCRIPTION OF THE PRIOR ART

Soap dispensers, which are commonly located in public washrooms and the like, include a frame, a manually operable pumping means mounted on the frame and a reservoir operatively connected to the pumping means for supplying soap to be dispensed to the pumping means. In this type of dispenser the pumping means usually comprises:

- a hollow squeeze tube having a longitudinal axis, a first end connected to the reservoir and a second open end for dispensing the soap, the second end including a valve means for permitting soap to flow;
- a wall member extending substantially parallel to said axis and proximate the tube;
- a manually operable pressing means facing the wall member and extending proximate the tube on the opposite side of the wall member, the pressing means and the wall member co-operating together to compress the tube when the pressing means is operated, the compression opening the valve means and subsequently squeezing the soap out of the tube and dispensing it therefrom.

Such soap dispenser can be peristaltic, where a portion of the tube near the first end is first squeezed, and subsequently the rest of the tube is compressed. This forms a pseudo-seal near the first end, preventing the soap from re-entering the reservoir as illustrated on FIGS. 3A, 3B, 4A and 4B of the present application. Otherwise, the tube can be provided with a no-return valve at the first end.

A deficiency in the prior soap dispensers has been either that they lack any convenient means of adjusting the volume of soap which is dispensed by each activation of the pumping means, or that the pump mechanism uses a piston, unlike the current dispenser which uses a mechanism based on the squeezing of a tube. By example, U.S. Pat. Nos. 4,036,406; 4,238,056 and 4,493,440 disclose dispensers for controlling the quantity of soap to be dispensed. In U.S. Pat. No. 4,036,406 the adjustment of output volume is accomplished by selectively adjusting the maximum effective stroke length of the piston. In U.S. Pat. No. 4,238,056 a selectively adjustable abutment means is associated with a pivotal actuating lever so that, by selectively adjustably varying the length of the actuating lever pivotal stroke, the consequent movement of the dispensing mechanism is likewise adjustably varied so as to increase or decrease the volume of soap dispensed by each dispenser actuation. U.S. Pat. No. 4,493,440 uses a rotary "stroke adjusting ring" for limiting the stroke of the piston to one of three different stroke lengths, thereby discharging only three different amounts of soap.

There is therefore a need for simple and efficient means for controlling the quantity of soap dispensed from dispensers comprising a dispensing mechanism based on the squeezing of a tube connected to a reservoir.

SUMMARY OF THE INVENTION

An important object of the invention is the provision of efficient means for controlling the quantity of soap dispensed from soap dispensers using the squeezing of a tube for dispensing soap from a reservoir. These means also have the advantage of being simple and economical to construct.

In accordance with the invention, this object is achieved with an improved liquid soap dispenser having a frame, a manually operable pumping means mounted on the frame and a reservoir operatively connected to the pumping means for supplying soap to be dispensed to the pumping means, the pumping means comprising:

- a hollow squeeze tube having a longitudinal axis, a first end connected to the reservoir and a second open end for dispensing the soap, the second end including a valve means for permitting soap to flow but preventing air from entering the tube;
- a wall member extending substantially parallel to the axis and proximate the tube;
- a manually operable pressing means facing the wall member and extending proximate the tube on the opposite side of the wall member, the pressing means and the wall member co-operating together to compress the tube when the pressing means is operated, the compression opening the valve means and subsequently squeezing the soap out of the tube and dispensing it therefrom; wherein in the improvement, the wall member includes means for adjusting a distance between the wall member and the pressing means with respect to the axis whereby a volume of the soap dispensed is modified.

The present invention is particularly adapted to soap dispensers in which the pumping action is peristaltic. Therefore, it is also an object of this invention to provide an improved soap dispenser of the type set forth wherein the wall member is pivotally connected to a pivot point forming a part of the frame having a pivot axis lying in a plane perpendicular to the longitudinal axis of the tube. The wall member has a top portion and a bottom portion, the top portion being connected to the pivot point. The wall member further has pivotal means operatively connected thereto for pivoting the wall member about the pivot point back and forth from a vertical position to an angular position. In the vertical position the wall member extends substantially parallel to the axis of the tube and proximate to the tube. In the angular position, the wall member extends obliquely away from the axis of the tube such that the bottom portion of the wall member is at an increased distance from the tube.

It is still a further object of this invention to provide an improved soap dispenser of the type set forth wherein the pivotal means includes:

- at least one tongue attached to the bottom portion of the wall member, the at least one tongue extending in a direction opposite the tube, and having a slot extending obliquely and upwards from the bottom portion;
- a block having a threaded hole, the hole having an axis substantially parallel to the longitudinal axis of the tube, and a rod extending perpendicularly from the axis of the hole, the rod having a portion inserted and snugly fitting within the slot of the at least one tongue so that the rod may travel back and forth within the slot from a first position close to the second end of the tube to a second position further from the second end;
- a manually operable screw having a longitudinal axis concurrent with the axis of the hole, a first end operatively connected to the frame and a second end being threaded, the second end co-operating with the threaded hole of the block such that a rotation of the screw moves the block in the axis of the screw and slides the rod within the slot thereby pivoting the wall member. Preferably, the threaded second end of the screw has a threaded portion at least as long as the slot.

Another object of this invention is to provide an improved soap dispenser of the type set forth wherein the pressing means comprises:

a manually operable handle extending substantially in the same axis as the tube, the handle having a first end pivotally connected to the frame and a second end extending outwardly from the frame in order to be accessible to a user such that the user may operate the pressing means, the handle being pivotable from a first position wherein the handle is substantially parallel to the tube to a second position wherein the tube is squeezed;

a lever having an upper end and a lower end, a front side and a back side, the front side of the lever facing the tube on the opposite side of the wall member and extending proximate the tube when the handle is in the first position, the lever being pivotally connected to the handle by a back side portion close to the lower end, such that when the handle is in the first position, the lever projects obliquely from the handle substantially towards the first end of the tube forming an angle with the handle, and when the handle is in the second position the lever extends parallel to the axis of the tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, and then subsequently squeezing the tube from its first end towards its second end creating a peristaltic movement dispensing the soap out of the tube, the tube having a flexibility providing a back pressure sufficient for forcing the return of the handle to the first position and also creating a suction sufficient to fill the tube with "new" soap from the reservoir when the handle is no longer activated.

Other objects and advantages of the present invention will be apparent from the following specification and the accompanying drawings which are for the purpose of illustration only.

DESCRIPTION OF THE PREFERRED EMBODIMENT

Figure 1:
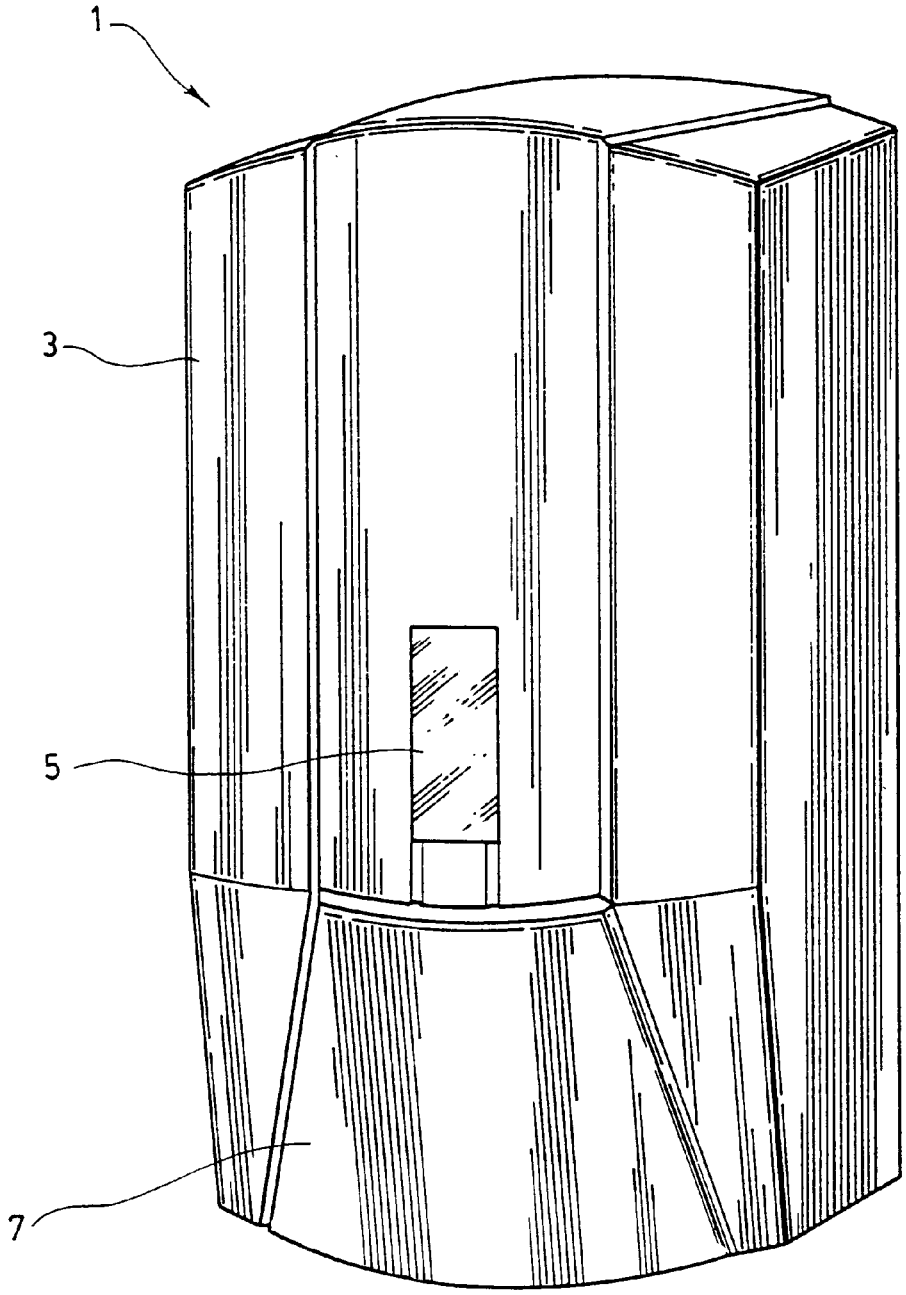
FIG. 1 is a perspective view of a preferred embodiment of a soap dispenser according to the invention.

Referring to FIG. 1 of the drawings, a preferred embodiment of a soap dispenser according to the invention is shown.

Although this dispenser is preferably a wall mounted liquid soap dispenser 1, other forms of flowable paste, creams and lubricant may also be dispensed. The dispenser 1 comprises a housing 3 mounted on a frame (not illustrated), and a transparent window 5 for seeing a level of soap remaining in a soap reservoir 21 located inside the housing. The dispenser further comprises a handle 7 pivotally connected to the frame.

Figure 2:
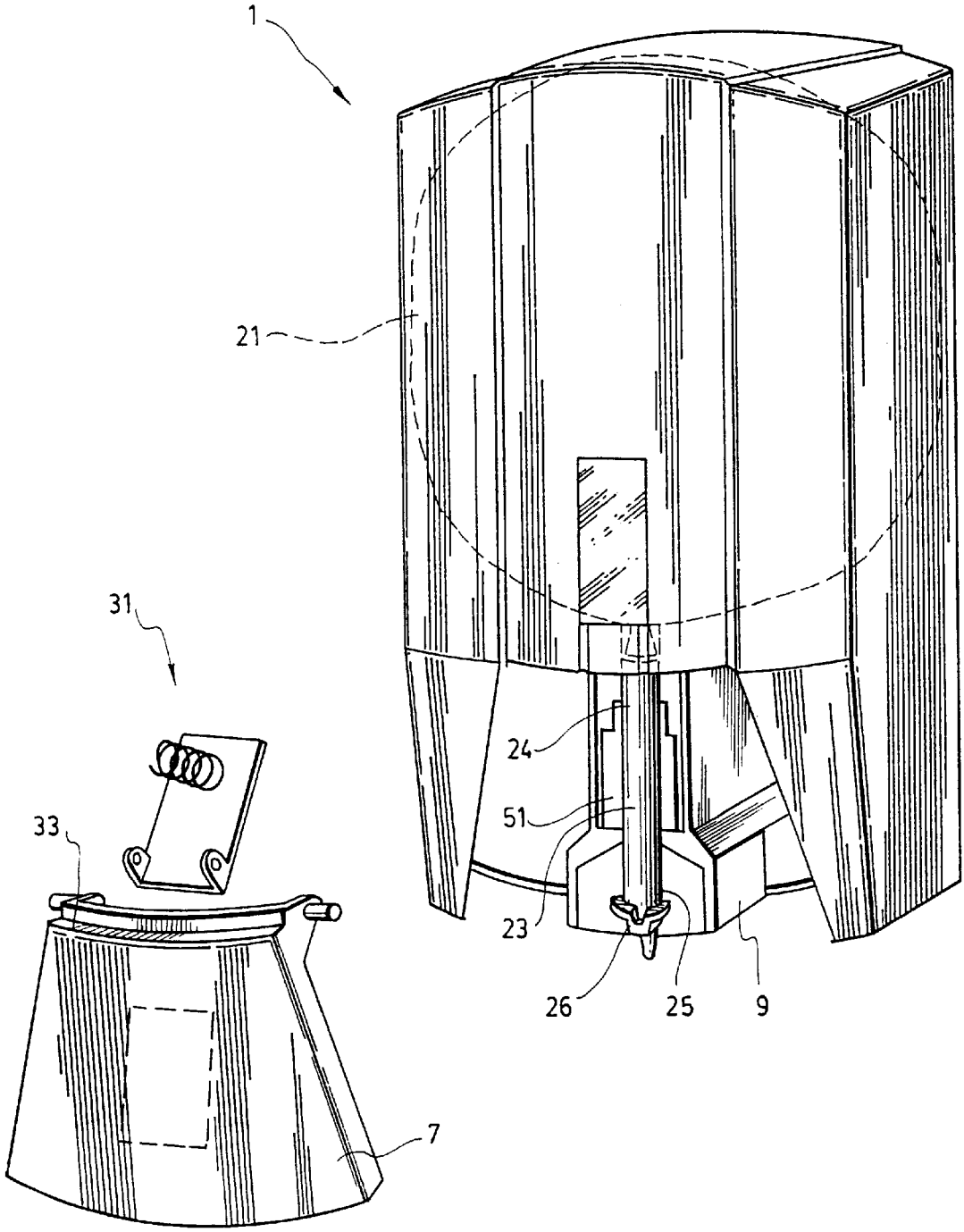
FIG. 2 is an exploded perspective view of the soap dispenser of FIG. 1, showing the inside dispensing mechanism.

Now referring to FIG. 2, where the handle 7 has been removed for partially showing the inside of the dispenser, a tube 23 extends downwardly from a reservoir 21 below the dispenser 1. A wall member 51, operatively connected to the frame 9, extends parallel to the tube 23.

As also shown, a pressing means 31 is pivotally connected to the handle 7. As it will be explained in greater details hereinafter, the pressing means 31 and the wall member 51 co-operate together such that a user activating the handle 7 can dispense soap from the dispenser 1.

Figure 5:
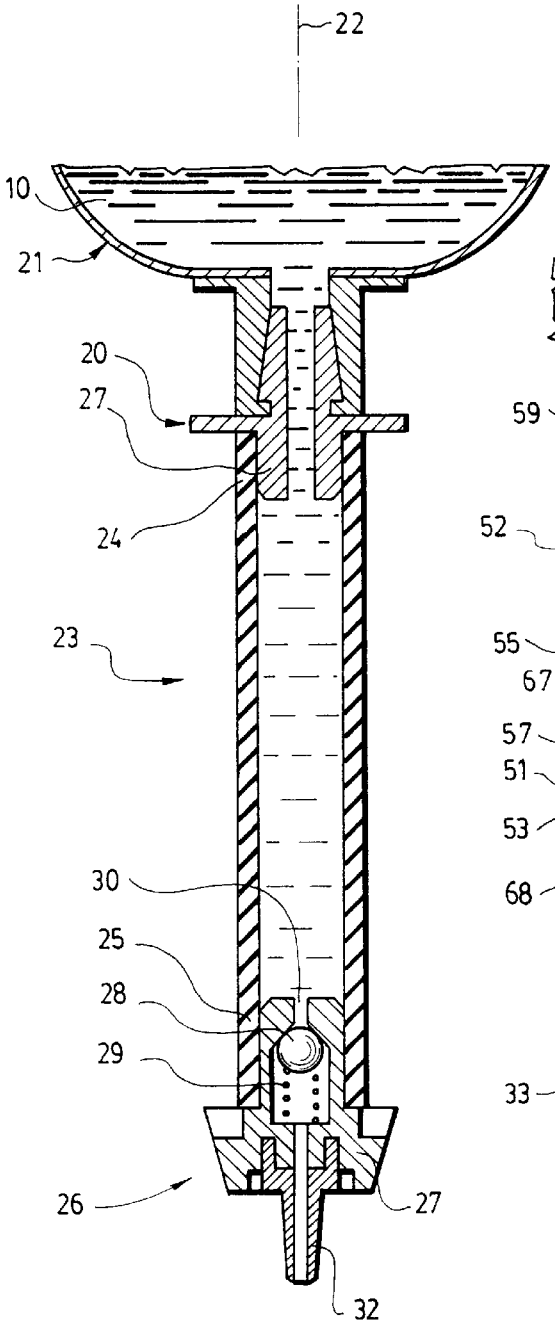
FIG. 5 is a partial cut view showing a tube connected by one of its end to a soap reservoir and having a check valve on its other end.

The tube 23 shown in greater details in FIG. 5, is hollow. It is also flexible and preferably made of rubber in order to be easily compressed. Rubber also has the advantage of returning to its original, uncompressed state. As also shown in FIG. 5, the tube 23 is connected by its first end 24 to the reservoir 21 preferably with the help of an adapter 20. A portion 27 of the adapter 20 fits tightly into the tube 23 and it is glued thereto. Once the adapter is connected to the reservoir, the soap 10 may be sucked into the tube 23 by operation of the pressing means 31 and the return of the tube 23 to its uncompressed state as it will be explained in greater details hereinafter. The adapter 20 is thus devised to fit tightly with the reservoir 21 in order to be watertight and prevent any leakage of soap 10. It is also devised to be detachably connected to the reservoir 21 in order to replace easily the latter when empty.

The tube further comprises at its second end 25 a valve means. The valve means is preferably an upper ball check valve 26 which opens for permitting soap to flow when the tube 23 is squeezed but closes for preventing air from entering the tube when the tube returns to the uncompressed state. The valve 26 when closed helps to create a sufficient suction within the tube 23 as the tube returns to its uncompressed state thereby pulling soap from the reservoir into the tube. The check valve 26 comprises a hollow cylindrical housing 27 into which a ball 28 is mounted on a spring 29. In a rest position, the spring 29 presses under the ball 28 such that the ball blocks an aperture 30 in which the soap may flow. Upon squeezing of the filled tube 23, the soap pushes onto the ball 28 such that the spring 29 is compressed thereby freeing the aperture 30 and permitting the soap to flow. An upper portion of the housing 27 fits tightly and into the tube 23 and is glued thereto in order to be watertight and prevent any leakage of soap. The housing 27 further comprises a tip 32 for accurately dispensing a sharp trickle of soap in the hand of the user. The housing 27 is also preferably devised to fit tightly into an especially designed cavity 33 in the frame (shown in FIG. 6). Therefore, the tube is detachably connected to the frame 9.

Figure 3B:
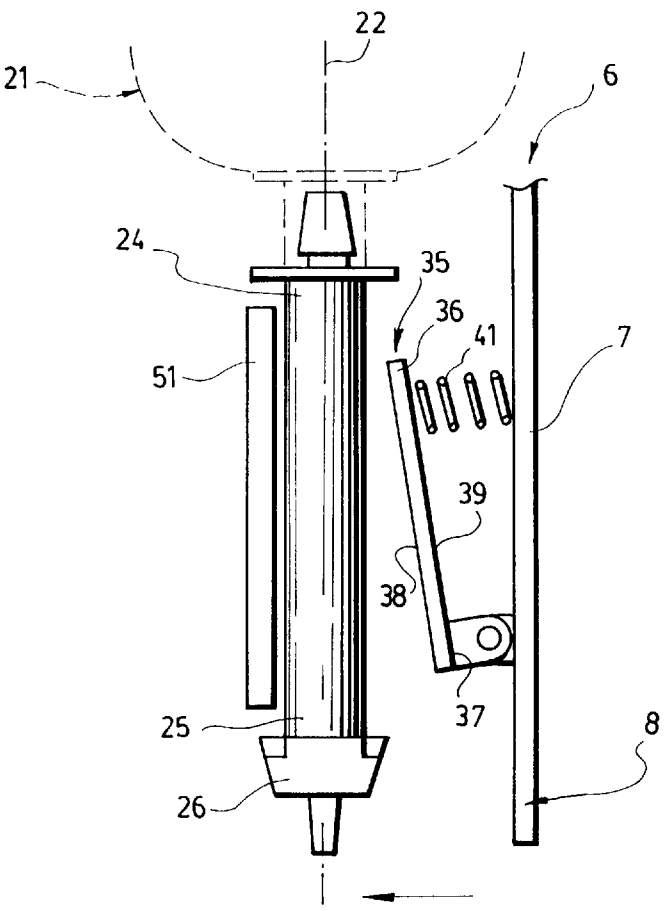
FIG. 3B ( PRIOR ART)
FIGS. 3A and 3B are partial side views of two models of pressing means known in the art in a release position with respect with a tube to be squeezed.
Figure 3A:
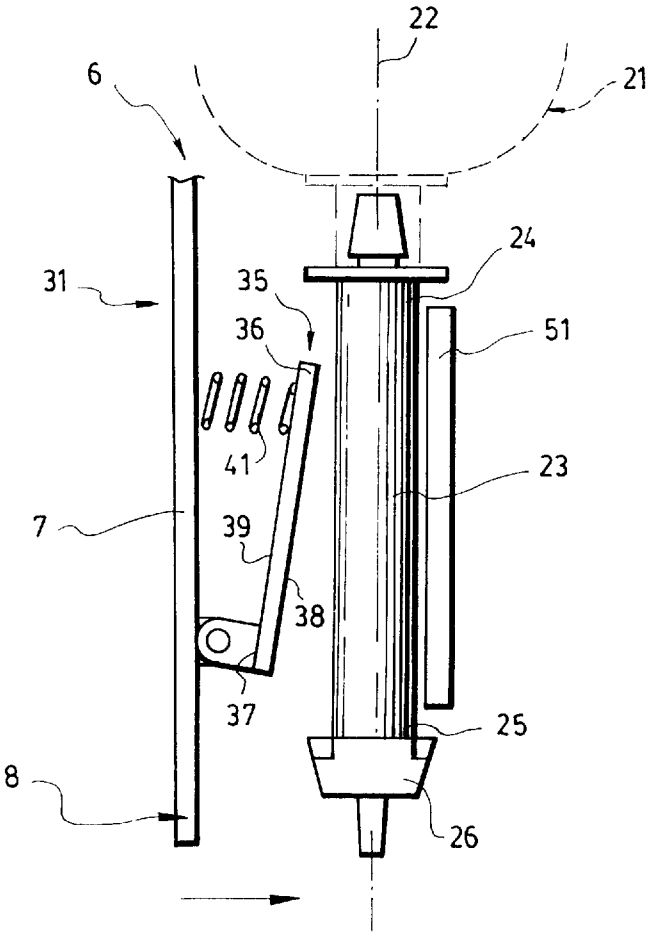
FIG. 3A ( PRIOR ART)
Figure 4B:
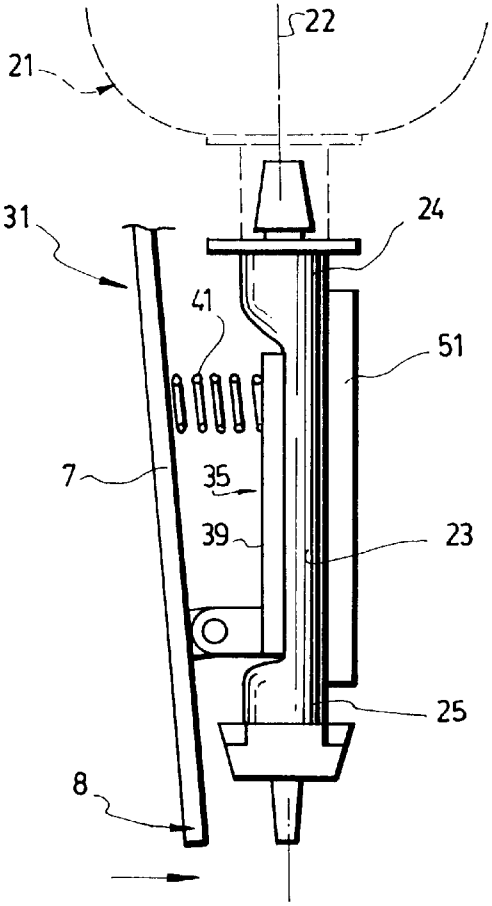
FIG. 4B (PRIOR ART)
FIGS. 4A and 4B are partial side views of the pressing means model of FIG. 3A, the pressing means being partially (FIG. 4A) or fully (FIG. 4B) activated thereby squeezing the tube accordingly.
Figure 4A:
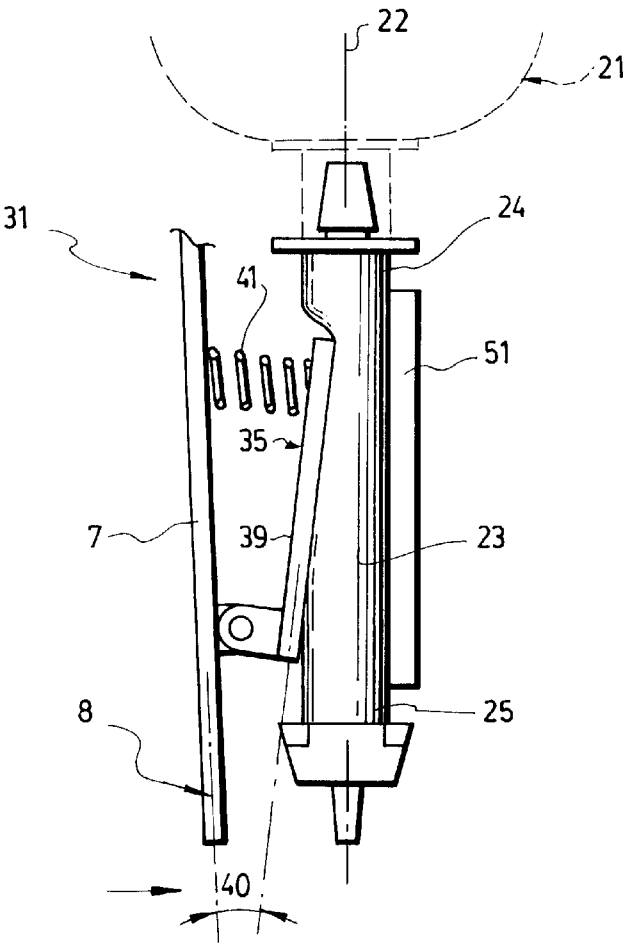
FIG. 4A (PRIOR ART)

Now referring to FIGS. 3 through 4, a known peristaltic pumping means mechanism based on the squeezing of a tube connected to a reservoir is shown. FIGS. 3A, 4A and 4B illustrate a pushing mechanism while FIG. 3B illustrates a pulling mechanism. By comparing FIGS. 3A and 3B it can be seen that both pumping means are mirror images of each other. Both comprise:

- a hollow squeeze tube 23 having a longitudinal axis 22, a first end 24 connected to a reservoir 21 and a second open end 25 for dispensing the soap, the second end including a valve means 26 for permitting soap to flow but preventing air from entering the tube 23;
- a wall member 51 extending substantially parallel to the axis 22 and proximate the tube 23;
- a manually operable pressing means 31 facing the wall member 51 and extending proximate the tube 23 on the opposite side of the wall member 51.

The pressing means comprises:

- a manually operable handle 7 extending substantially in the same axis as the tube 23, the handle 7 having a first end 6 pivotally connected to the frame (not shown) and a second end 8 extending outwardly from the frame in order to be accessible to a user such that the user may operate the pressing means;
- a lever 35 having an upper end 36 and a lower end 37, and a front side 38 and a back side 39, the front side 38 of the lever 35 facing the tube 23 on the opposite side of the wall member 51 and extending proximate the tube 23 when the handle is in a first position, the lever 35 being pivotally connected to the handle 7 by a back side portion close to the lower end 37; and
- a biasing means such as a spring 41 operatively connected to the handle 7 and to a back side portion of the lever 35 close to the upper end 36, the spring 41 providing a biasing pressure for maintaining the lever 35 obliquely away from the handle 7.

As illustrated in FIGS. 4A and 4B, the pressing means 31 and the wall member 51 co-operate together to compress the tube 23 when the pressing means is operated. As shown, the handle 7 is pivoted from a first position wherein it is substantially parallel to the tube 23 (FIG. 4A), to a second position wherein the tube 23 is squeezed (FIG. 4B). When the handle 7 is in the first position (FIG. 4A), the lever 35 projects obliquely substantially towards the first end 24 of the tube 23, forming thereby an angle 40 with the handle 7. When the handle is in the second position (FIG. 4B) the lever 35 extends substantially parallel to the axis 22 of the tube 23. As can also be appreciated, when the pressing means 31 is operated, the spring 41 is compressed gradually, thereby reducing the angle 40 of the lever 35 with respect to the handle 7. The lever 35 first squeezes the first end 24 of the tube (thereby forming a pseudo-seal), then subsequently squeezes the tube 23 from its first end 24 towards its second end 25 in a peristaltic movement dispensing the soap out of the tube 23. Since the tube 23 is flexible, it restores itself to its original shape when the handle 7 returns to the first position. The flexibility of the tube also provides a back pressure favoring the return of the handle 7 to the first position when the pumping means are no longer activated. By restoring its original shape, the tube 23 also creates a suction sufficient to fill the tube 23 with "new" soap from the reservoir.

Figure 6:
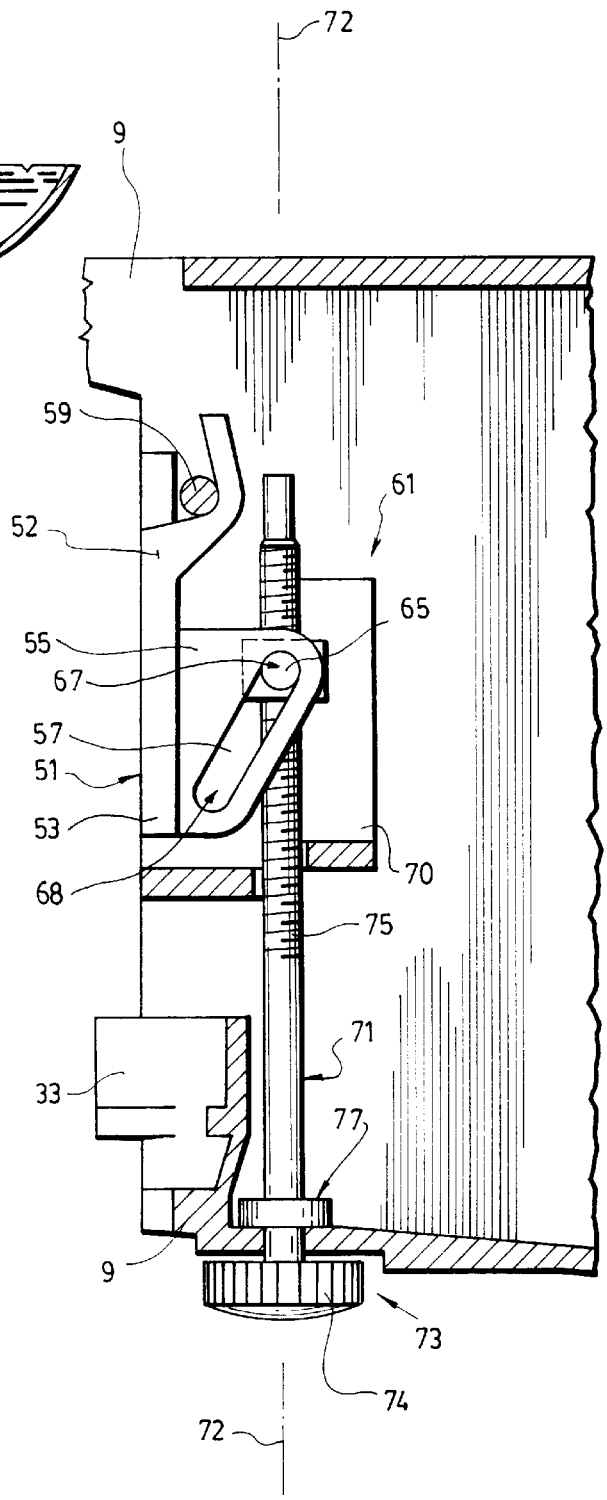
FIG. 6 is a partial cut view of a pivotal means according to the invention for controlling the volume of soap to be dispensed.

FIGS. 6 to 9 show a preferred embodiment of the invention wherein the wall member 51 includes means for adjusting a distance between the wall member 51 and the pressing means 31. As shown in FIG. 6, the wall member 51 has a top portion 52 and a bottom portion 53. The top portion 52 is pivotally connected to a pivot point 59 forming a part of the frame 9. The pivot point 59 lies in a plane perpendicular to the tube 23 longitudinal axis 22. Pivotal means 61 are operatively connected to the wall member 51 for its pivotal about the pivot point 59 back and forth from a vertical position to an angular position. In the vertical position the wall member extends substantially parallel to the axis 22 of the tube and proximate to the tube 23. In the angular position the wall member extends obliquely away from the axis of the tube such that its bottom portion 53 is at an increased distance from the tube 23. FIGS. 9A, 9B and 9C illustrate such various positions of the wall member 51.

Figure 7:
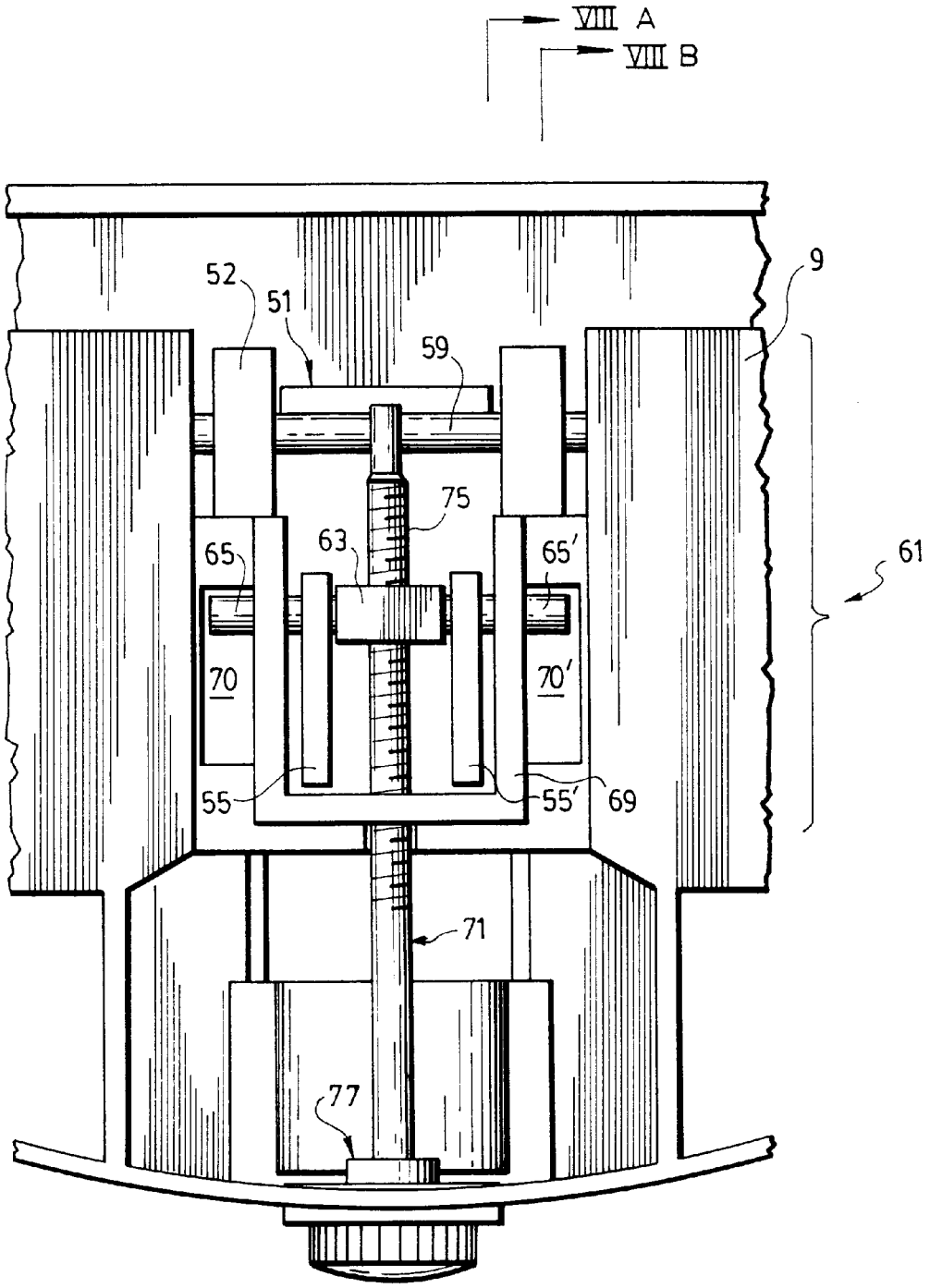
FIG. 7 is a partial back perspective view of the pivotal means of FIG. 6.

Referring more specifically to FIGS. 6 and 7, the pivotal means 61 includes at least one tongue 55 attached to the bottom portion 53 of the wall member 51. Preferably, as illustrated in FIG. 7, two tongues 55 and 55' are provided. Each tongue 55 and 55' extends in a direction opposite the tube. The tongues 55 and 55' have a slot 57 extending obliquely and upwards from the bottom portion 53 of the wall member 51.

Figure 8B:
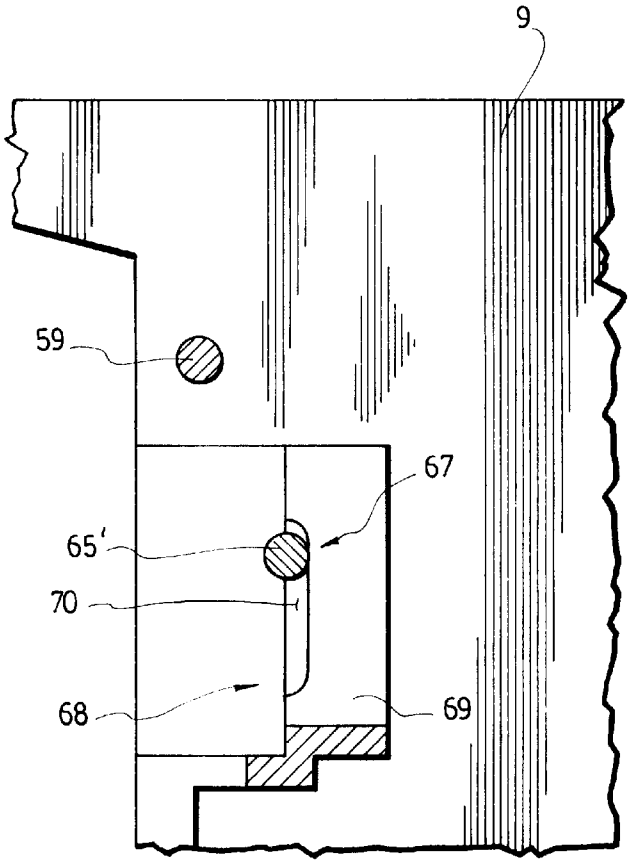
FIGS. 8A and 8B are partial section views respectively taken along lines "A" and "B" of FIG. 7.
Figure 8A:
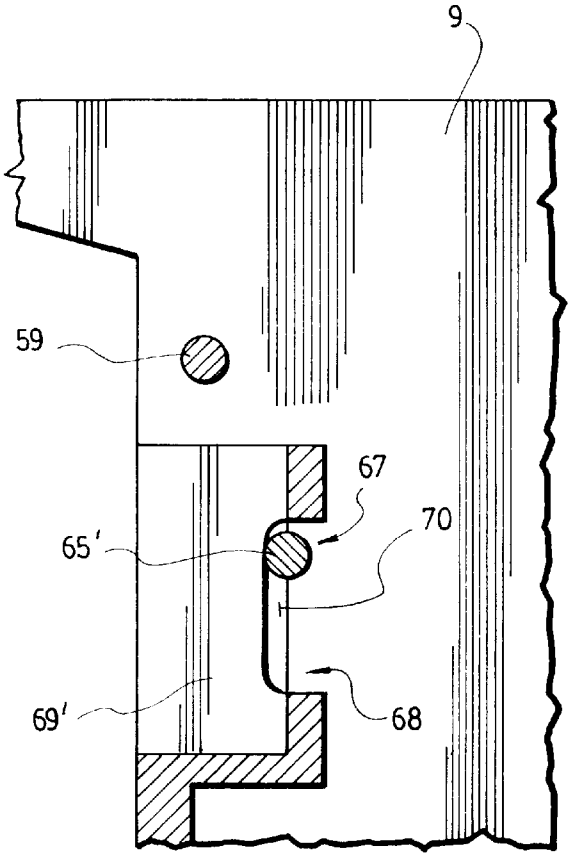

The pivotal means 61 also include a block 63 having a threaded hole having an axis substantially parallel to the longitudinal axis 22 of the tube 23. As shown more particularly in FIG. 7, a manually operable screw 71 is inserted into the hole for moving the block 63 as it will be explained herein below. Rods 65 and 65' extend perpendicularly from the axis of the hole in opposite directions and each rod 65 and 65' has a portion inserted and snugly fitting within the slot 57 of the corresponding tongue 55. As shown more particularly in FIG. 8, each rod 65 and 65' also extends into a corresponding longitudinal slot 70 and 70' having an axis perpendicular to the axis of the corresponding rod. For example, the slot 70 illustrated in FIG. 8 is the slot of rod 65'. The slot 70' is formed in part by an inversed C-shaped wing 69 extending outwardly from the frame 9 towards the rod 65 and in part by a C-shaped tack 69' found inside the frame 9. The slot 70 is the mirror image of slot 70'. Accordingly, as can be appreciated in FIG. 6, the rod 65 may travel back and forth within the slots 57 and 70 from a first upper position 67 close to the second end 25 of the tube 23 to a second lower position 68 further from said second end 25. Furthermore, since the rod 65 travels vertically in the wing's slot 70 but obliquely in the tongue's slot 57, such a travelling results in the pivoting the wall member 51 about the pivot point 59 (see FIGS. 9B and 9C).

Referring again to FIGS. 6, 7 and 9, the pivotal means 61 further include a manually operable screw 71 having a longitudinal axis 72 concurrent with the axis of the hole of the block 63. The screw 71 has a first end 73 operatively connected to the frame 9 and a threaded second end 75 co-operating with the block 63. This first end 73 extends underneath the frame 9 and comprises a wheel 74 allowing a user to easily rotate the screw 71. The second end 75 is threaded with the threaded hole of the block 63 such that a rotation of the screw 71 moves the block in the axis 72 of the screw 71 and slides the rod 65 within the slots 57 and 70 from the first upper position 67 to the second lower position 68. Obviously, to move between the first position 67 and second position 68, the second end 75 of the screw 71 must have a threaded portion at least as long as the slot 57.

As best shown in FIG. 6, the screw 71 also comprises means for keeping the screw 71 in place within the frame 9.

In the illustrated preferred embodiment, a small slotted ring 77 is inserted around a lower portion of the screw 71. The ring 77 cooperates with the screw 71 and with the frame 9 such that the screw 71 is rotatable but not vertically moveable. Without such means (the ring 77 in the illustrated preferred embodiment) the screw 71 would simply unscrew out of the block 63 without moving the same.

Figure 9B:
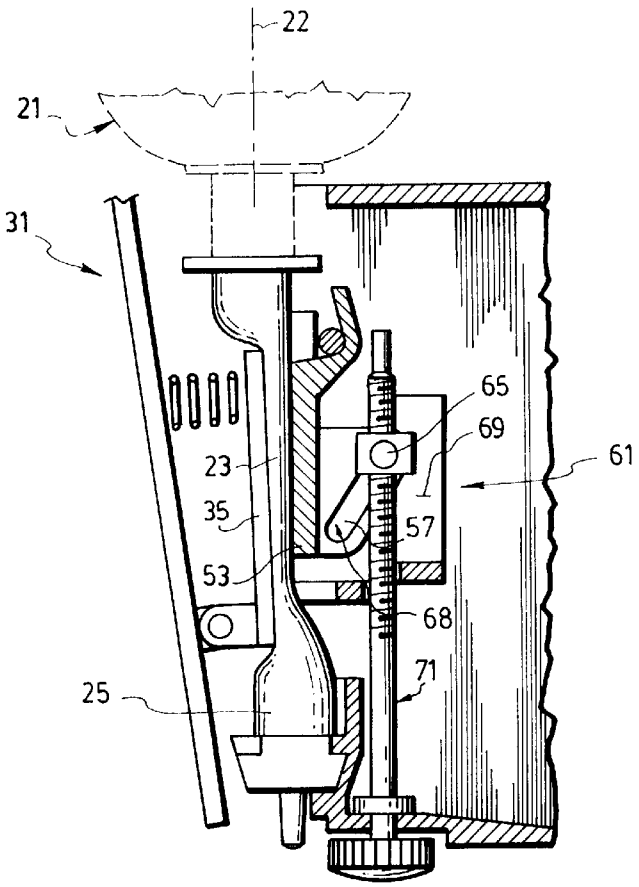
FIGS. 9A, 9B and 9C are partial side cross-section views of the pressing and the pivotal means, the pressing means being in a release position (9A), or in a squeezing position (9B and 9C), the pivotal means being adjusted for dispensing a maximum volume of soap (9B) or a minimum volume (9C).
Figure 9A:
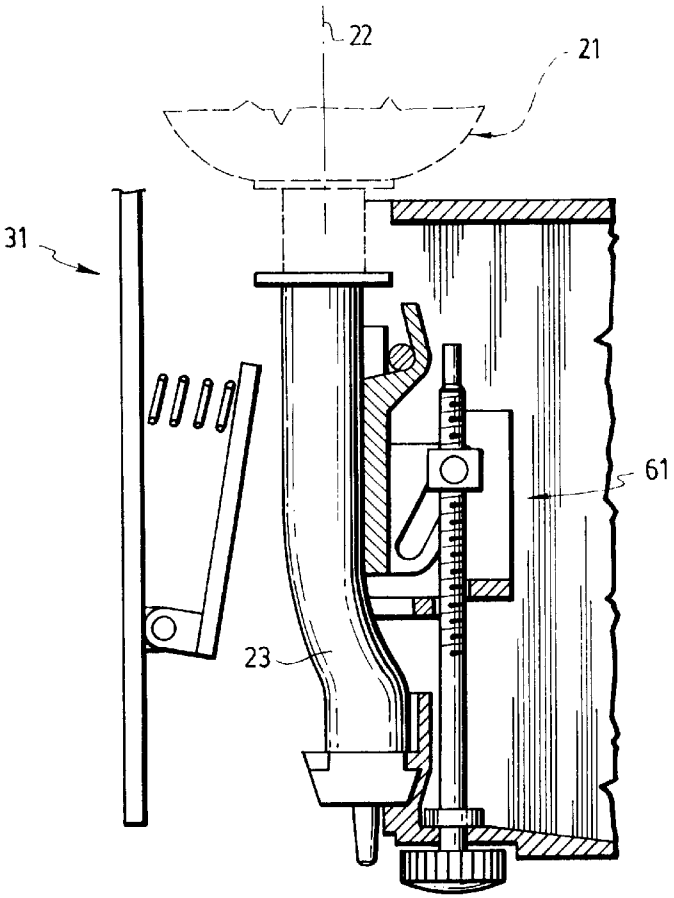
Figure 9C:
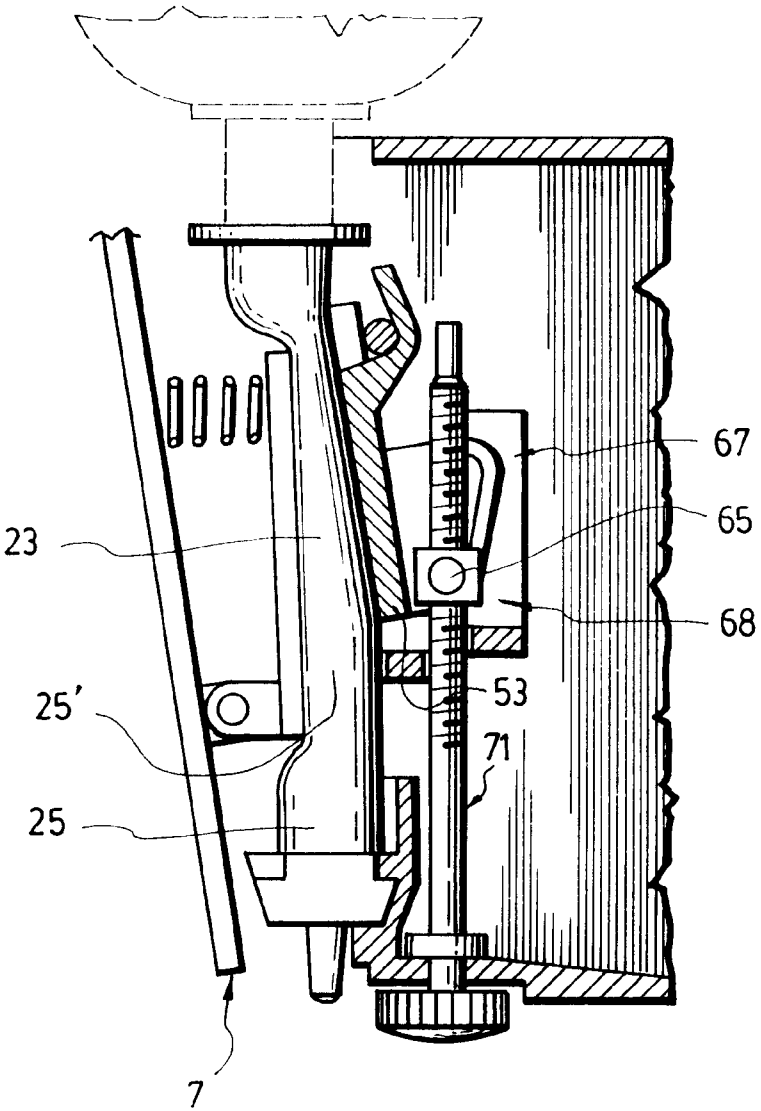

FIGS. 9A, 9B and 9C illustrate the present improved soap dispenser in operation. As shown in FIG. 9A the pressing means 31 is in a release position. In such position, the pressing means 31 extends substantially proximate and parallel to the tube 23. In FIG. 9B, the pressing means 31 is at a maximum pressing position thereby squeezing the tube 23. As shown in FIG. 9B, the pivotal means 61 is positioned such that the wall member 51 extends parallel to the tube 23. As can be appreciated, the rod 65 is found within the slot 57 in the first upper position 67 further from the second end 25 of the tube 23 than the second lower position 68. In such vertical position, the wall member 51 and the lever 35 thus fully co-operate together so that the tube 23 is fully squeezed thereby dispensing a maximum volume of soap.

In FIG. 9C, the pressing means 31 is also at a maximum pressing position thereby squeezing the tube. However, the pivotal means 61 are positioned such that the wall member 51 extends obliquely away from the axis 22 of the tube 23. The bottom portion of the wall member is thus at an increased distance from the axis 22 as compared with FIG. 9B. As can be appreciated, the rod 65 is located within the lower position 66 of the slot 57. In such an oblique position, the wall member 51 co-operates less efficiently with the lever 35 so that the tube 23 is not fully squeezed, especially a portion 25' close to the second end 25 which is almost not squeezed. Accordingly, the volume of soap dispensed by the activation of the handle 7, is reduced to a minimum. According to the present invention, by varying more or less the oblique position of the wall member 51 it is thus easy to control the volume of soap dispensed.

The soap dispenser including the various components thereof may be fabricated of usual materials and by usual manufacturing processes.

Obviously, other forms of means for adjusting a distance between the wall member and the pressing means may exist. For example, the wall member may comprise at least one shaft extending outwardly from the back thereof, the shaft being provided with teeth co-operating with the frame. Thus, by pulling onto this shaft, the user could move the wall member in a longitudinal axis perpendicular to the axis of the tube. A similar shaft could also be pivotally connected to the back of the wall member such that by pulling onto the shaft, the user could manually pivot the wall member about an axis in a way similar to the preferred embodiment described in detail above. However, it should be understood that any design for adjusting the volume of soap should be able to withstand the full pressure applied to the pumping means. One advantage of the preferred embodiment described herein, is that the pressure of the pumping action cannot apply directly to the means for adjusting the distance between the wall member and the pressing means. In fact in order to open the spring loaded check valve, there has to be a substantial pressure build up inside the tube. Accordingly, any variations on the present invention should allow as little flexibility as possible in the area where full pressure is applied to the pumping means, since flexibility could relieve some of the pressure necessary to open the valve and thus delay the opening of the valve.

Accordingly, although preferred embodiments of the invention have been described in detail herein and illustrated in the accompanying drawings, it is to be understood that the invention is not limited to these precise embodiments and that various changes and modifications may be effected therein without departing from the scope or spirit of the invention. The improvements of the present invention are applicable to many forms of liquid soap dispensers and the like incorporating a pumping means for squeezing out soap from a tube connected to a soap reservoir. Therefore, the present invention is to be considered as including all possible modifications and variations thereof coming within the scope of the invention as defined by the appended claims.

What is claimed is:

1. In a liquid soap dispenser having a frame, a manually operable pumping means mounted on the frame and a reservoir operatively connected to said pumping means for supplying soap to be dispensed to said pumping means, the pumping means comprising:

a hollow squeeze tube having a longitudinal axis, a first end connected to said reservoir and a second open end for dispensing the soap, the second end including a valve means for permitting soap to flow but preventing air from entering the tube;

a wall member extending substantially parallel to said axis and proximate said tube;

a manually operable pressing means facing the wall member and extending proximate the tube on the opposite side of the wall member, the pressing means and the wall member co-operating together to compress said tube when said pressing means is operated, said compression opening said valve means and subsequently squeezing the soap out of said tube and dispensing it therefrom;

the improvement wherein the wall member includes means for adjusting a distance between said wall member and said pressing means with respect to said axis whereby a volume of said soap dispensed is modified.

2. The soap dispenser according to claim 1, wherein the wall member has a top portion and a bottom portion, said top portion being pivotally connected to a pivot point part of the frame, said pivot point lying in a plane perpendicular to said longitudinal axis, the wall member further having pivotal means operatively connected to said wall member for pivoting the wall member about said pivot point back and forth from a vertical position wherein the wall member is extending substantially parallel to the axis of the tube and proximate to said tube, to an angular position wherein the wall member extends obliquely away from the axis of the tube and wherein the bottom portion of the wall member is at an increased distance from said tube.

3. The soap dispenser according to claim 2, wherein said pivotal means includes:

at least one tongue attached to the bottom portion of the wall member, said at least one tongue extending in a direction opposite said tube, said at least one tongue having a slot extending obliquely and upwards from said bottom portion;

a block having a threaded hole having an axis substantially parallel to the longitudinal axis of the tube, and at least one rod extending perpendicularly from the axis of the hole, said rod having a portion inserted and snugly fitting within the slot of said at least one tongue so that the rod may travel back and forth within said slot from a first position close to the second end of the tube to a second position further from said second end;

a manually operable screw having a longitudinal axis concurrent with the axis of the hole, a first end operatively connected to the frame and a second end being threaded, the second end co-operating with the threaded hole of the block such that a rotation of said screw moves the block in the axis of the screw and slides the rod within the slot thereby pivoting the wall member.

4. The soap dispenser according to claim 3, wherein the threaded second end of the screw has a threaded portion at least as long as the slot.

5. The soap dispenser according to claim 4, wherein the block is movable back and forth on said threaded portion from a first position to a second position, said first position being close to an extremity of the second end of the screw, the block having the first position when the rod is in the first position within the slot, said second position being further from said extremity and closer to the first end of the screw, the block having the second position when the rod is in the second position within the slot.

6. The soap dispenser according to claim 1, wherein the pressing means comprises:

a manually operable handle extending substantially in the same axis as the tube, the handle having a first end pivotally connected to the frame and a second end extending outwardly from the frame in order to be accessible to a user such that the user can operate said pressing means, the handle being pivotable from a first position wherein the handle is substantially parallel to the tube to a second position wherein the tube is squeezed;

a lever having an upper end and a lower end, and a front side and a back side, the front side of the lever facing the tube on the opposite side of the wall member and extending proximate said tube when the handle is in the first position, the lever being pivotally connected to the handle by a back side portion close to the lower end, such that when the handle is in the first position, said lever projects obliquely from the handle substantially towards the first end of the tube forming thereby an angle with the handle, and when the handle is in the second position the lever extends parallel to the axis of said tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, then subsequently squeezing the tube from its first end towards its second end creating a peristaltic movement dispensing the soap out of the tube, said tube having a flexibility providing a back pressure sufficient for forcing the return of the handle to said first position and also creating a suction sufficient to fill the tube with soap from the reservoir when said handle is no longer activated.

7. The soap dispenser according to claim 2, wherein the pressing means comprises:

a manually operable handle extending substantially in the same axis as the tube, the handle having a first end pivotally connected to the frame and a second end extending outwardly from the frame in order to be accessible to a user such that the user can operate said pressing means, the handle being pivotable from a first position wherein the handle is substantially parallel to the tube to a second position wherein the tube is squeezed;

a lever having an upper end and a lower end, and a front side and a back side, the front side of the lever facing the tube on the opposite side of the wall member and extending proximate said tube when the handle is in the first position, the lever being pivotally connected to the handle by a back side portion close to the lower end, such that when the handle is in the first position, said lever projects obliquely from the handle substantially towards the first end of the tube forming thereby an angle with the handle, and when the handle is in the second position the lever extends parallel to the axis of said tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, then subsequently squeezing the tube from its first end towards its second end creating a peristaltic movement dispensing the soap out of the tube, said tube having a flexibility providing a back pressure sufficient for forcing the return of the handle to said first position and also creating a suction sufficient to fill the tube with soap from the reservoir when said handle is no longer activated.

8. The soap dispenser according to claim 3, wherein the pressing means comprises:

a manually operable handle extending substantially in the same axis as the tube, the handle having a first end pivotally connected to the frame and a second end extending outwardly from the frame in order to be accessible to a user such that the user can operate said pressing means, the handle being pivotable from a first position wherein the handle is substantially parallel to the tube to a second position wherein the tube is squeezed;

a lever having an upper end and a lower end, and a front side and a back side, the front side of the lever facing the tube on the opposite side of the wall member and extending proximate said tube when the handle is in the first position, the lever being pivotally connected to the handle by a back side portion close to the lower end, such that when the handle is in the first position, said lever projects obliquely from the handle substantially towards the first end of the tube forming thereby an angle with the handle, and when the handle is in the second position the lever extends parallel to the axis of said tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, then subsequently squeezing the tube from its first end towards its second end creating a peristaltic movement dispensing the soap out of the tube, said tube having a flexibility providing a back pressure sufficient for forcing the return of the handle to said first position and also creating a suction sufficient to fill the tube with soap from the reservoir when said handle is no longer activated.

9. The soap dispenser according to claim 4, wherein the pressing means comprises:

a manually operable handle extending substantially in the same axis as the tube, the handle having a first end pivotally connected to the frame and a second end extending outwardly from the frame in order to be accessible to a user such that the user can operate said pressing means, the handle being pivotable from a first position wherein the handle is substantially parallel to the tube to a second position wherein the tube is squeezed;

a lever having an upper end and a lower end, and a front side and a back side, the front side of the lever facing the tube on the opposite side of the wall member and extending proximate said tube when the handle is in the first position, the lever being pivotally connected to the handle by a back side portion close to the lower end, such that when the handle is in the first position, said lever projects obliquely from the handle substantially towards the first end of the tube forming thereby an angle with the handle, and when the handle is in the second position the lever extends parallel to the axis of said tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, then subsequently squeezing the tube from its first end towards its second end creating a peristaltic movement dispensing the soap out of the tube, said tube having a flexibility providing a back pressure sufficient for forcing the return of the handle to said first position and also creating a suction sufficient to fill the tube with soap from the reservoir when said handle is no longer activated.

10. The soap dispenser according to claim 5, wherein the pressing means comprises:

a manually operable handle extending substantially in the same axis as the tube, the handle having a first end pivotally connected to the frame and a second end extending outwardly from the frame in order to be accessible to a user such that the user can operate said pressing means, the handle being pivotable from a first position wherein the handle is substantially parallel to the tube to a second position wherein the tube is squeezed;

a lever having an upper end and a lower end, and a front side and a back side, the front side of the lever facing the tube on the opposite side of the wall member and extending proximate said tube when the handle is in the first position, the lever being pivotally connected to the handle by a back side portion close to the lower end, such that when the handle is in the first position, said lever projects obliquely from the handle substantially towards the first end of the tube forming thereby an angle with the handle, and when the handle is in the second position the lever extends parallel to the axis of said tube;

a biasing means operatively connected to the handle and to a back side portion close to the upper end of the lever, the biasing means providing a biasing pressure for maintaining the lever obliquely away from the handle such that when the pressing means is operated the biasing means is compressed gradually, thereby reducing the angle of the lever with respect to the handle, the lever first squeezing the first end of the tube thereby forming a pseudo-seal, then subsequently squeezing the tube from its first end towards its second end creating a peristaltic movement dispensing the soap out of the tube, said tube having a flexibility providing a back pressure sufficient for forcing the return of the handle to said first position and also creating a suction sufficient to fill the tube with soap from the reservoir when said handle is no longer activated.

11. The soap dispenser according to claim 1, wherein the valve means is a check valve.

12. The soap dispenser according to claim 2, wherein the valve means is a check valve.

13. The soap dispenser according to claim 3, wherein the valve means is a check valve.

14. The soap dispenser according to claim 4, wherein the valve means is a check valve.

15. The soap dispenser according to claim 5, wherein the valve means is a check valve.

16. The soap dispenser according to claim 6, wherein the valve means is a check valve.

17. The soap dispenser according to claim 7, wherein the valve means is a check valve.

18. The soap dispenser according to claim 8, wherein the valve means is a check valve.

19. The soap dispenser according to claim 9, wherein the valve means is a check valve.

20. The soap dispenser according to claim 10, wherein the valve means is a check valve.

* * * * *